US008311264B2

(12) United States Patent
Lee

(10) Patent No.: US 8,311,264 B2
(45) Date of Patent: Nov. 13, 2012

(54) ULTRA-THIN SPEAKER

(75) Inventor: Ping-Yu Lee, Taoyuan County (TW)

(73) Assignee: Fortune Grand Technology Inc., Taoyuan County (TW)

( * ) Notice: Subject to any disclaimer, the term of this patent is extended or adjusted under 35 U.S.C. 154(b) by 308 days.

(21) Appl. No.: 12/766,136

(22) Filed: Apr. 23, 2010

(65) Prior Publication Data

US 2011/0085694 A1 Apr. 14, 2011

(30) Foreign Application Priority Data

Oct. 9, 2009 (TW) ..... 98218637 U

(51) Int. Cl.
*H04R 1/00* (2006.01)

(52) U.S. Cl. ..... 381/423; 381/405; 381/429; 381/431

(58) Field of Classification Search ..... 381/405, 381/423, 431, 429
See application file for complete search history.

(56) References Cited

U.S. PATENT DOCUMENTS

| | | | | |
|---|---|---|---|---|
| 5,757,945 | A * | 5/1998 | Sakamoto | 381/400 |
| 5,903,658 | A * | 5/1999 | Okazaki et al. | 381/428 |
| 2002/0176596 | A1 * | 11/2002 | Fujinami et al. | 381/409 |
| 2006/0153420 | A1 * | 7/2006 | Takase et al. | 381/424 |

* cited by examiner

*Primary Examiner* — Mohamad Musleh
*Assistant Examiner* — Ronald Hinson
(74) *Attorney, Agent, or Firm* — Rosenberg, Klein & Lee

(57) ABSTRACT

An ultra-thin speaker includes a metal upper casing, and a metal lower casing corresponding to the metal upper casing and capable of covering a vibrating membrane, a support frame, a magnet and a yoke between two corresponding internal surfaces of the metal upper and lower casings and forming a contact surface with the yoke, such that after the yoke conducts heat of a heat source to the metal lower casing, the heat is conducted to the metal upper casing through a connection and a contact of the metal upper and lower casings to increase a heat dissipating area, so as to overcome the heat dissipation problem and minimize the overall thickness of the speaker.

10 Claims, 4 Drawing Sheets

ULTRA-THIN SPEAKER

BACKGROUND OF THE INVENTION (a) Field of the Invention

The present invention relates to an ultra-thin speaker, and more particularly to an ultra-thin speaker with a structure of conducting heat of a heat source to a metal upper casing by a thermal conduction to increase a heat dissipating area.

(b) Description of the Related Art

As 3C electronic devices such as mobile phones (or handsets), MP3 players, notebook computers (NB), liquid crystal displays (LCD), and personal digital assistants (PDA) have an enhanced operating performance, a compact design, and a multimedia function, the 3C electronic devices generally adopt an appropriate mini speaker for an audio output interface.

Speaker is an electro-acoustic device for converting electronic signals into audio signals, and producing a repulsion with a magnetic member to provide a piston-like action after a voice coil is electrically conducted, such that a vibrating membrane installed in front of the magnetic member is pushed accordingly to radiate sound waves in front of the vibrating membrane in all directions to the outside. However, the operation of the voice coil and the magnetic member may cause a high temperature easily, and the high temperature issue has become an inevitable drawback.

Since present existing consumer products become smaller and smaller, the electronic or plastic components installed inside the products are very close to the position of the speaker, therefore the piston action between the voice coil and the magnetic member will produce a high temperature after the voice coil of the speaker is electrically conducted. The high temperature not just affects the sound quality and performance of the speaker, but also affects the operation of adjacent components of the electronic device. Even worse, the continuously increasing temperature may burn the voice coil or damage the electronic device, or may even cause accidents.

The aforementioned speaker body has a poor heat dissipating effect, and the poor heat dissipation may burn the voice coil. The high temperature also affects the existing sound quality and performance. Therefore, manufacturers have provided solutions to overcome the heat dissipation issue of the voice coil. These solutions mainly include an improved convection of air, an improved structure of a speaker body, and an improved metal heat dissipating material.

As disclosed in R.O.C. Pat. No. 00305509, a dust-resisting cover of a speaker is made of a metal material instead, and the dust-resisting cover is installed to an opening of a voice coil directly, such that the heat produced by the voice coil can be discharged from the metal dust-resisting cover.

In an improved speaker assembly as disclosed in R.O.C. Pat. No. 00431741, external cold air is introduced into a gap between a voice coil and a magnetic member, and heat is discharged to the outside during the operation the speaker in order to avoid overheat of the voice coil.

As disclosed in R.O.C. Pat. No. 00453601, a circular heat sink is installed onto a voice coil directly and wrapped by a magnetic member for dissipating a high-temperature heat produced by the voice coil and the magnetic member.

As disclosed in R.O.C. Pat. No. M249394 (with a foreign counterpart P.R.C. Pat. No. ZL02288716.4), a heat dissipating plate is adhered onto a voice coil and a rear end of a magnetic member for discharging hot air produced in the operation of the speaker to avoid overheat of the voice coil.

In P.R.C. Pat. No. ZL200620014749.2, a circular heat sink similar to a washer (which is a magnetic conducting plate installed on a speaker body) is disclosed, wherein the heat sink is a serrated structure capable of expediting the dissipation of heat energy of the voice coil.

In P.R.C. Pat. No. ZL200720000787.7, a concave heat dissipating device is disclosed, and a magnetic yoke (U-shaped iron) under a magnet is installed in the concave heat dissipating device, and a thermal paste is applied to connect the magnetic yoke and the concave heat dissipating device securely, such that when the heat of the speaker body is conducted to the magnetic yoke, heat can be discharged quickly and directly to the outside through the external concave heat dissipating device.

In P.R.C. Pat. No. ZL99217826.6, a plurality of heat dissipating holes are formed around the periphery of a magnetic yoke (T-shaped iron), and a circular hole is formed on a magnetic pillar, and a plurality of fins are installed at the bottom of the magnetic yoke for improving the heat dissipating efficiency.

In P.R.C. Pat. No. ZL200520053787.4, the magnetic conduction of the original magnetic yoke (U-shaped iron) is separated from the function of fixing the magnetic member. By changing the material of the magnetic yoke from the traditional iron material to a lightweight material, we can reduce the weight of the speaker and achieve the effects of dissipating heat. Meanwhile, a heat sink is installed outside the magnetic yoke to improve the heat dissipating efficiency.

In P.R.C. Pat. No. ZL200420083784.0, a structure of an internal magnetic speaker body is disclosed to improve the heat dissipating efficiency of the speaker body and enhance the sound quality of base. In the improved internal magnetic speaker body structure, a serrated heat sink is installed outside a magnetic yoke (U-shaped iron) for conducting the heat of a voice coil to the heat sink through the magnetic yoke. Meanwhile, the heat sink includes an open groove formed in the circumferential direction and extended into an air chamber behind the vibrating membrane through an opening formed on a support frame of the speaker, such that the resonance frequency point F0 can be minimized without using an additional speaker enclosure to achieve the effect of enhancing the sound quality of base.

However, the methods or structures for solving the heat dissipation problem of the voice coil in accordance with the aforementioned prior arts still have a drawback of having a too-large volume that cannot fit in the limited space of the thin speaker.

In R.O.C. Pat. No. M352209 (with a foreign counterpart P.R.C. Pat. No. ZL2008201353250) issued to the inventor of the present invention, the structure of a thin mini speaker heat dissipating device is disclosed, wherein a metal plate is installed around a U-shaped magnetic yoke, such that the heat produced by the magnetic yoke can be conducted to the outside. Although this structure provides a function of dissipating heat to a certain extent, the metal plate must be installed in the space inside upper and lower casings, so that the heat dissipating area is limited. Furthermore, the overall thickness is still several millimeters, and such thickness still cannot meet the requirements of present electronic products such as mobile phones.

In view of the foregoing shortcomings of the prior arts, the inventor of the present invention further improves the heat dissipating efficiency and the thickness of the thin mini speakers in accordance with the present invention.

SUMMARY OF THE INVENTION

The primary object of the present invention is to provide an ultra-thin speaker that makes use of heat conduction to conduct heat of an internal heat source to a metal lower casing through a yoke and then conducts the heat to the metal upper casing to increase a heat dissipating area, so as to overcome the heat dissipating problem of the conventional thin speaker.

Another object of the present invention is to overcome the heat dissipation problem of the conventional thin speaker by reducing the overall thickness of the speaker (to approximately 1.5 mm) to facilitate the internal spatial design of an electronic product and achieve the functions of a thin speaker.

In order to achieve the above-mentioned objects, the invention includes:

a) a metal upper casing, having an external surface, an internal surface, and one or more sound holes formed at the middle of the metal upper casing;

b) a vibrating membrane, positioned at the internal surface of the metal upper casing;

c) a voice coil, positioned at the bottom of the vibrating membrane;

d) a support frame, positioned at the bottom of the metal upper casing and the vibrating membrane, and having a first hollow hole formed at the middle of the support frame;

e) a magnet, positioned in the first hollow hole;

f) a yoke, positioned at the bottom of the support frame; and g) a metal lower casing, positioned corresponding to the metal upper casing, and having an external surface and an internal surface, and provided for covering the aforementioned components between the two corresponding internal surfaces, and forming a contact surface with the yoke;

such that after the yoke conducts heat of a heat source to the metal lower casing, the heat is conducted to the metal upper casing through a connection and a contact between the upper and lower casings to increase a heat dissipating area.

DETAILED DESCRIPTION OF THE PREFERRED EMBODIMENT

Figure 1:
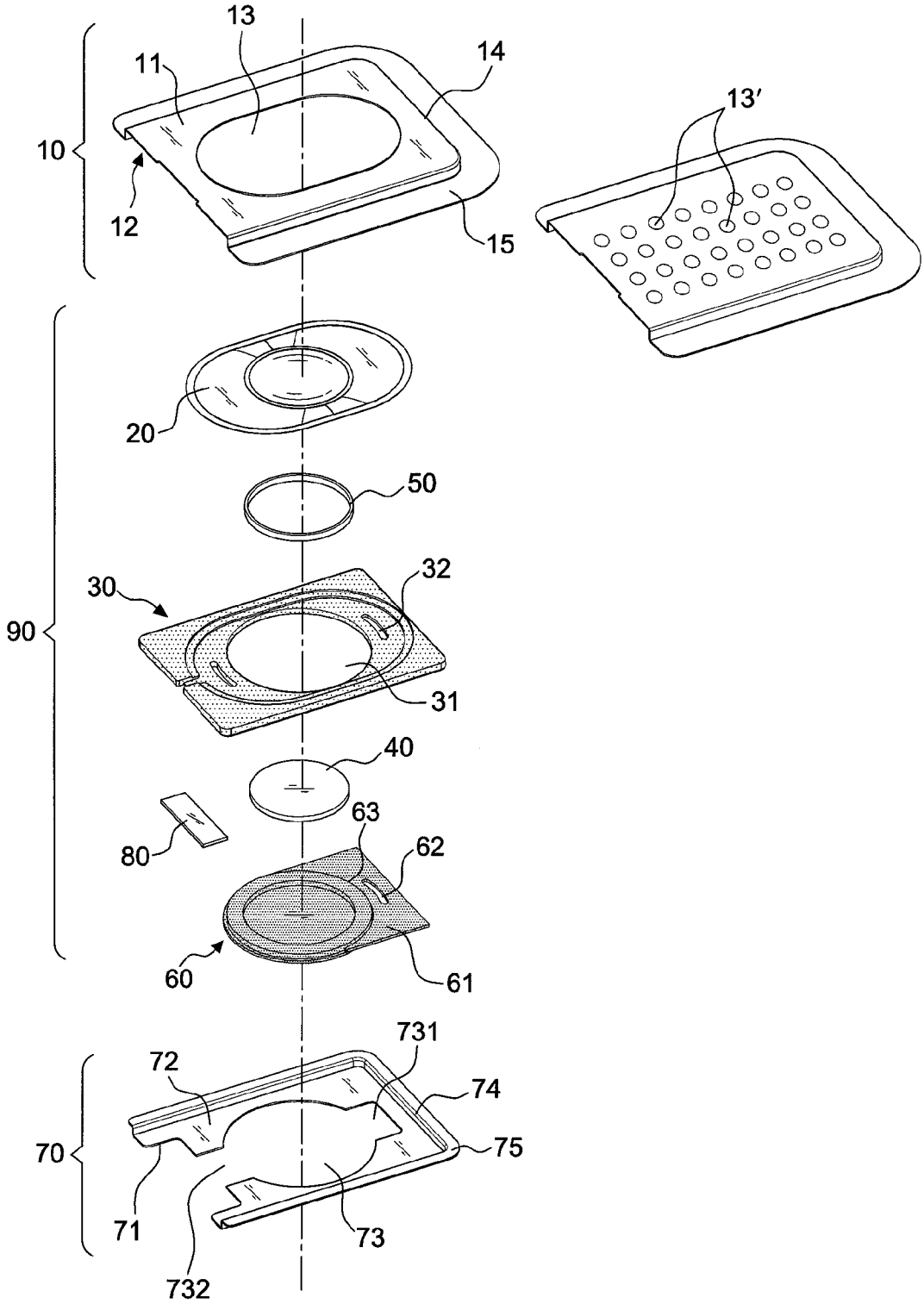
FIG. 1 is an exploded view of an ultra-thin speaker in accordance with a preferred embodiment of the present invention.
Figure 2:
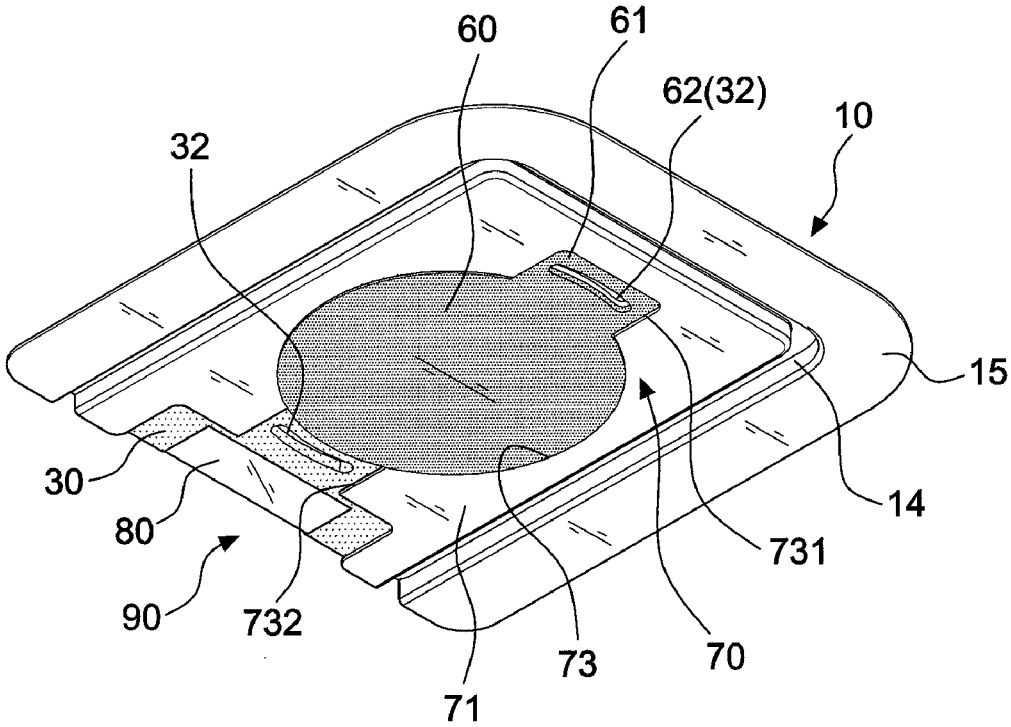
FIG. 2 is a perspective view of an ultra-thin speaker in accordance with a preferred embodiment of the present invention.
Figure 3:
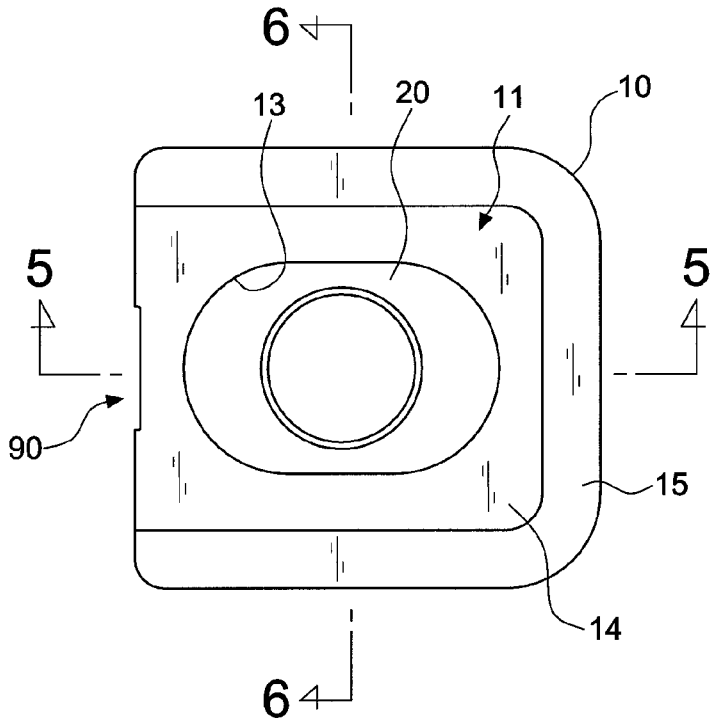
FIG. 3 is a top view of an ultra-thin speaker in accordance with a preferred embodiment of the present invention.
Figure 4:
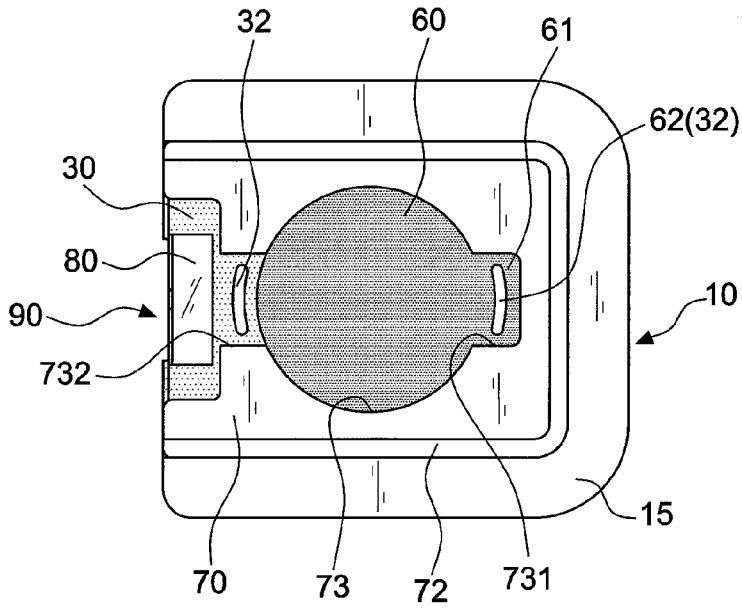
FIG. 4 is a bottom view of an ultra-thin speaker in accordance with a preferred embodiment of the present invention.
Figure 5:
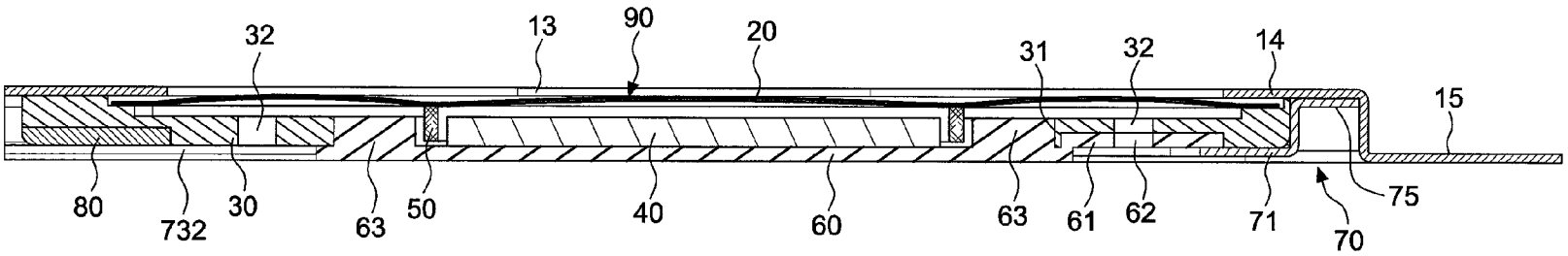
FIG. 5 is a cross-sectional view of Section 5-5 of FIG. 3.
Figure 6:
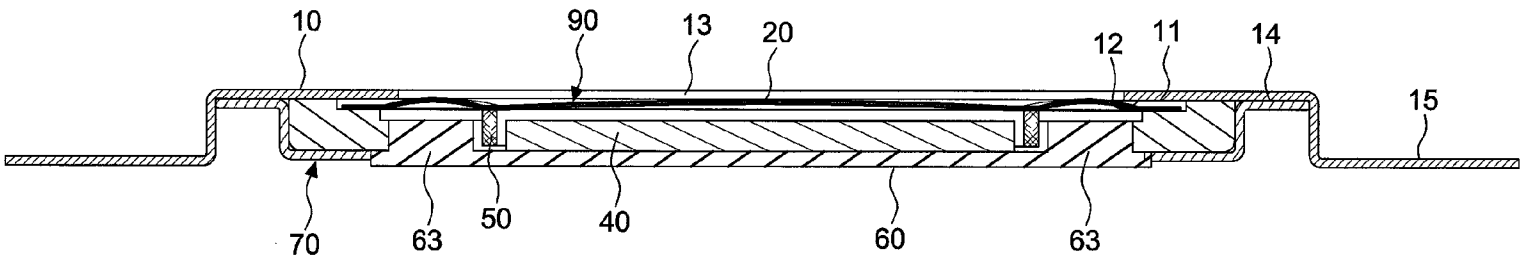
FIG. 6 is a cross-sectional view of Section 6-6 of FIG. 3.

With reference to FIGS. 1 to 6 for an ultra-thin speaker in accordance with a preferred embodiment of the present invention, the ultra-thin speaker comprises the following elements:

A metal upper casing 10 is formed by stamping a thin metal sheet, and the meal upper casing 10 has an external surface 11, and an internal surface 12 having one or more sound holes 13 formed at the middle of the metal upper casing. In this preferred embodiment, a cross-section of the metal upper casing 10 is in a ⊔ shape having a protrusion 14 formed at the middle of the metal upper casing 10 and a flange 15 formed at the periphery of the metal upper casing 10, but the invention is not limited to such arrangement only, and the sound hole 13 is a large elliptic hole or composed of a plurality of small holes 13'. Either the large elliptic hole or the plurality of small holes can be adopted in the invention.

A vibrating membrane 20 is positioned on the internal surface 12 of the metal upper casing 10 for producing a sound and dispersing the sound from the sound hole 13, 13' to the outside. In this preferred embodiment, the vibrating membrane 20 is in an elliptic shape, but the invention is not limited to such arrangement only.

A voice coil 50 is positioned at the bottom of the vibrating membrane 20.

A support frame 30 is made of a plastic or metal material and positioned at the bottom of the metal upper casing 10 and the vibrating membrane 20, and a first hollow hole 31 is formed at the middle of the support frame 30, such that a large portion at the middle of the bottom of the vibrating membrane 20 is exposed. In this preferred embodiment, the first hollow hole 31 is in a circular shape, but the invention is not limited to the circular shape only, and the support frame 30 further includes one or more first ventilation holes 32 formed at the periphery of the support frame 30. In addition, the support frame 30 further includes a terminal board 80 positioned at an external side of the bottom of the support frame 30 for connecting an external audio source signal.

A magnet 40 is positioned in the first hollow hole 31 and disposed at the bottom edge of the vibrating membrane 20. In this preferred embodiment, the voice coil 50 is in a ring-shape and positioned around the external periphery of the magnet 40.

A yoke 60 is positioned at the bottom of the support frame 30. In this preferred embodiment, the yoke 60 includes an extended surface 61, but the invention is not limited to such arrangement only. The extended surface 61 provides an extra heat dissipating area and includes a second ventilation hole 62 formed thereon. In addition, the yoke 60 includes a protruding ring 63 disposed on a surface of the yoke 60 and provided for accommodating the voice coil 50 and the magnet 40. In this preferred embodiment, the yoke 60 is a thin member with heat dissipating and magnetic conducting functions. The protruding ring 63 is made of a magnet or includes a magnet positioned at a surface of the protruding ring 63, but the invention is not limited to such arrangements only.

The aforementioned vibrating membrane 20, support frame 30, magnet 40, voice coil 50, and yoke 60 constitute a mini speaker body 90.

A metal lower casing 70 is formed corresponding to the metal upper casing 10, and has an external surface 71 and an internal surface 72, and the mini speaker body 90 composed of the aforementioned components is covered by the two corresponding internal surfaces 12, 72 and formed a contact surface with the yoke 60, such that after the yoke 60 conducts heat of the magnet 40 and the voice coil 50 to the metal lower casing 70, the connection and the contact of the metal upper and lower casings 10, 70 will conduct the heat to the metal upper casing 10 to increase a heat dissipating area.

To increase the contact surface for the thermal conduction of the metal upper and lower casings 10, 70. The metal lower casing 70 of this preferred embodiment includes a cross-section in a ⊔ shape to form a recession 74 at the middle and a contact surface 75 around the periphery. In a preferred embodiment, the contact surface 75 is embedded into an internal surface of the protrusion (14) of the metal upper casing 10, but the invention is not limited to such arrangement only. This embodiment has the following advantages. The metal lower casing 70 can be engaged and fixed with the metal upper casing 10 quickly by a manufacturing process, and such structural design not only improves the overall mechanical strength, but also maintains the overall thickness within the range of the expected thinness. For example, the overall thickness of the speaker body 90 is within 1.5 mm after the metal upper and lower casings 10, 70 are engaged, but the invention is not limited to such arrangement only. The ultra-thin speaker of the invention has an ultra thin thickness and provides a high heat dissipating efficiency, so that the ultra-thin speaker can fit into a small space inside the electronic products and achieve a thin design.

The metal lower casing 70 includes a recession 74 having a second hollow hole 73, and a radial depression 731 formed at an internal rim of the second hollow hole 73 and a notch 732 formed at an external rim of the second hollow hole 73. The depression 731 is disposed at a position corresponding to the first ventilation hole 32 and the second ventilation hole 62 to facilitate ventilation. The notch 732 is disposed on an internal side of the terminal board 80 and electrically coupled to the speaker body 90. Of course, the detailed structure can be modified according to practical needs. For example, the metal lower casing 70 of the present invention is not limited to be embedded into the internal surface of the protrusion 14 of the metal upper casing 10, and an equivalent structure can be adopted and included within the range of the present invention.

What is claimed is:

1. An ultra-thin speaker, comprising:

a) a metal upper casing, having an external surface, an internal surface, and one or more sound holes formed at the middle of the metal upper casing;

b) a vibrating membrane, positioned at the internal surface of the metal upper casing;

c) a voice coil, positioned at the bottom of the vibrating membrane;

d) a support frame, positioned at the bottom of the metal upper casing and the vibrating membrane, and having a first hollow hole formed at the middle of the support frame;

e) a magnet, positioned in the first hollow hole;

f) a yoke, positioned at the bottom of the support frame; and g) a metal lower casing, positioned corresponding to the metal upper casing, and having an external surface and an internal surface, and provided for covering the aforementioned components between the two corresponding internal surfaces, and forming a contact surface with the yoke; such that after the yoke conducts heat of a heat source to the metal lower casing, the heat is conducted to the metal upper casing through a connection and a contact between the upper and lower casings to increase a heat dissipating area;

wherein the metal upper casing has an inverted U-shaped cross-section contour to form a protrusion at the middle of the metal upper casing, and a flange around the periphery of the upper metal casing;

the metal lower casing has a U-shaped cross-section contour to form a recession at the middle of the metal lower casing and a contact surface around the periphery of the metal lower casing, and the contact surface is embedded into an internal surface of the protrusion of the metal upper casing; and the metal lower casing includes a recession having a second hollow hole, and a radial depression formed at an internal rim of the second hollow hole and a notch formed at an external rim of the second hollow hole.

2. The ultra-thin speaker as recited in claim 1, wherein the sound hole of the metal upper casing is in an elliptic shape.

3. The ultra-thin speaker as recited in claim 1, wherein the sound hole of the metal upper casing is composed of a plurality of small holes.

4. The ultra-thin speaker as recited in claim 1, wherein the first hollow hole is in a circular shape, and the support frame further includes one or more first ventilation holes formed at the periphery of the support frame.

5. The ultra-thin speaker as recited in claim 1, wherein the support frame is made of a plastic or metal material.

6. The ultra-thin speaker as recited in claim 1, wherein the support frame further includes a terminal board installed at an external side of the bottom of the support frame for connecting an external audio source signal.

7. The ultra-thin speaker as recited in claim 1, wherein the yoke includes an extended surface at the internal side thereof, and a second ventilation hole is formed on the extended surface.

8. The ultra-thin speaker as recited in claim 1, wherein the yoke includes a protruding ring disposed on a surface of the yoke and provided for accommodating the voice coil and the magnet.

9. The ultra-thin speaker as recited in claim 8, wherein the protruding ring is constructed as a magnet.

10. The ultra-thin speaker as recited in claim 8, wherein a magnet is positioned around the top surface of the protruding ring.

* * * * *